US006468057B1

(12) United States Patent
Beck

(10) Patent No.: US 6,468,057 B1
(45) Date of Patent: Oct. 22, 2002

(54) FREE PISTON PUMP

(76) Inventor: Douglas S. Beck, 3319 21st Ave. NW., Gig Harbor, WA (US) 98335

( * ) Notice: Subject to any disclaimer, the term of this patent is extended or adjusted under 35 U.S.C. 154(b) by 0 days.

(21) Appl. No.: 09/660,708

(22) Filed: Sep. 13, 2000

Related U.S. Application Data

(60) Provisional application No. 60/153,614, filed on Sep. 13, 1999.

(51) Int. Cl.[7] ..... F04B 17/04

(52) U.S. Cl. ..... 417/417; 417/411; 417/416

(58) Field of Search ..... 417/411, 416, 417/417, 418, 536

(56) References Cited

U.S. PATENT DOCUMENTS

| | | | | |
|---|---|---|---|---|
| 4,087,205 A | | 5/1978 | Heintz | |
| 4,365,942 A | * | 12/1982 | Schmidt | 417/412 |
| 4,389,849 A | | 6/1983 | Gasser et al. | |
| 5,106,274 A | * | 4/1992 | Holtzapple | 417/388 |
| 5,172,554 A | | 12/1992 | Swift et al. | |
| 5,411,374 A | | 5/1995 | Gram | |
| 5,477,690 A | | 12/1995 | Gram | |
| 5,551,488 A | | 9/1996 | Gram | |
| 5,575,626 A | | 11/1996 | Brown et al. | |
| 5,787,940 A | | 8/1998 | Bonn et al. | |
| 5,800,139 A | | 9/1998 | Yamada | |
| 5,807,083 A | | 9/1998 | Tomoiu | |

FOREIGN PATENT DOCUMENTS

| | | |
|---|---|---|
| GB | 1186663 | 4/1970 |
| SU | 1802283 | 3/1993 |

OTHER PUBLICATIONS

Arp, v. and Weiserd, J. G. II, Handbook of Cryogenic Engineering, Taylor & Francis, Philadelphia PA 1998 pp. 380–393.

* cited by examiner

*Primary Examiner*—Charles G. Freay
*Assistant Examiner*—W Rodriguez

(57) ABSTRACT

A free piston pump has a pump housing defining a chamber, and a free piston located within the chamber. The free piston defines one (or more) pumping chamber(s). Each pumping chamber receives fluid from one (or more) inlet port(s) and delivers fluid to one (or more) outlet port(s). The pump has an electromagnetic drive system for moving the free piston within the chamber. Check valves or porting can be used to admit fluid into the pumping chamber(s) and release fluid from the pumping chamber(s). The pump can use three types of bearings and two types of seals. The pump has small heat leakage to the fluid being pumped. The pump is insensitive to cavitation, and has the potential for long-life. The pump has low leakage to the ambient environment.

26 Claims, 7 Drawing Sheets

Power Source
10
44
101
106
16
16
107
20
14
105
110
130
108
34
42
102
33
32
103
27
31
31
35
110
104
105
106
107

FIG.3
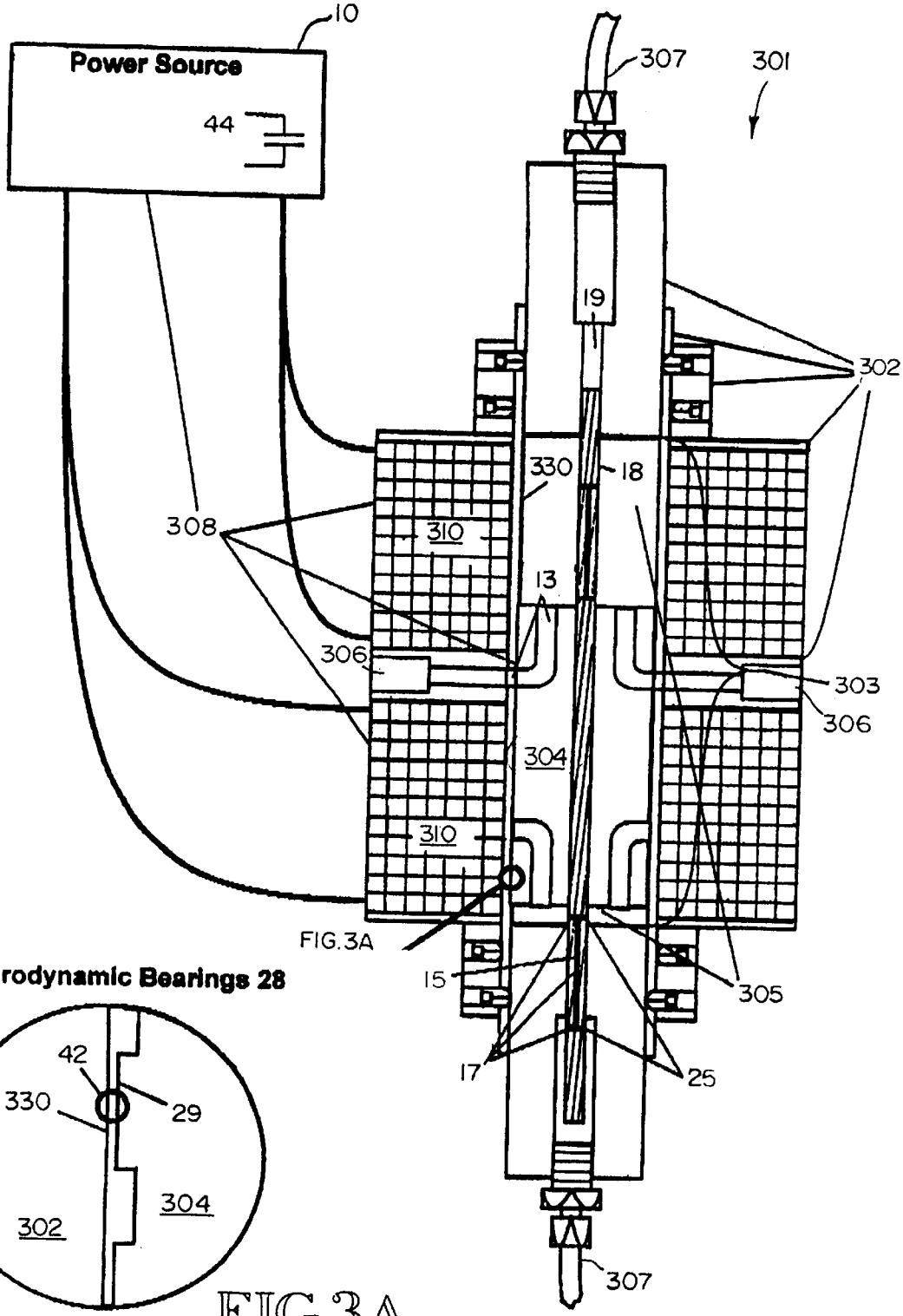
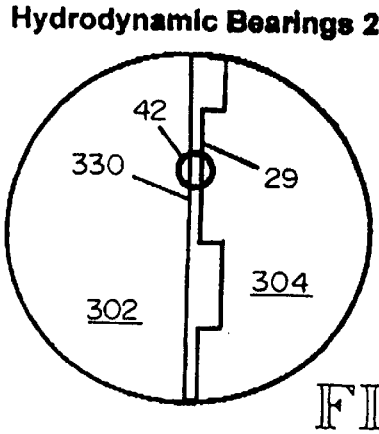
FIG.3A

FIG. 4A
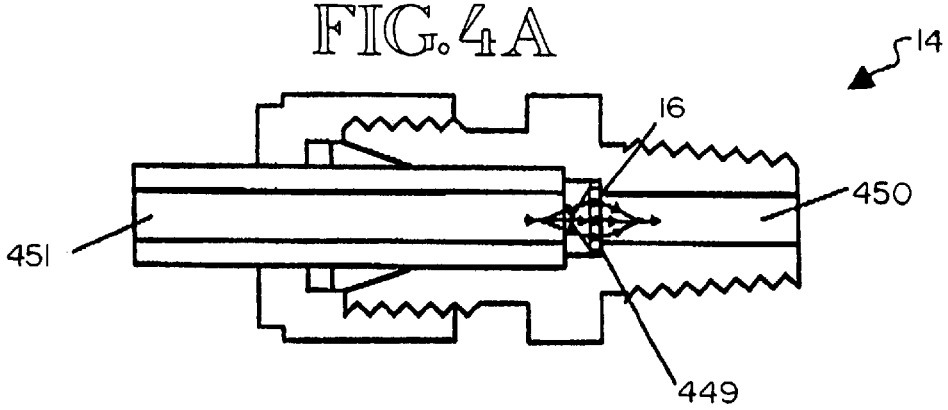
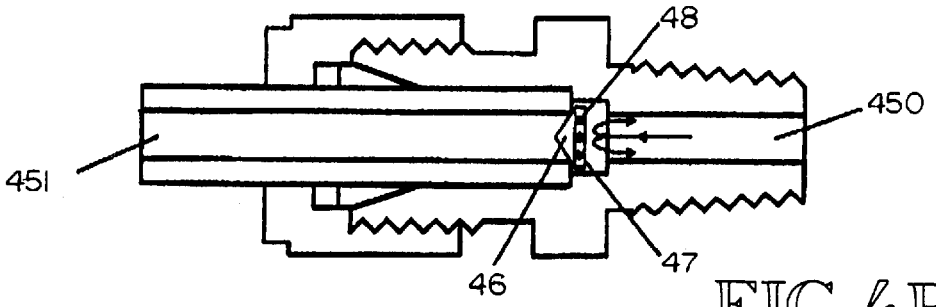
FIG. 4B
FIG. 4C
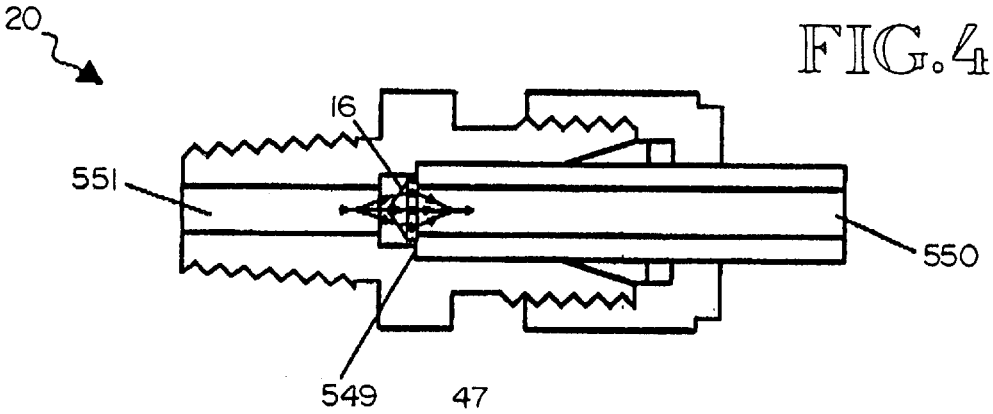
FIG. 4D
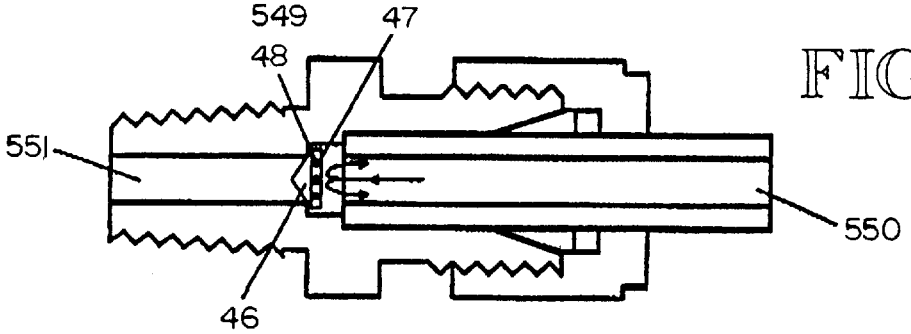

FIG. 6A
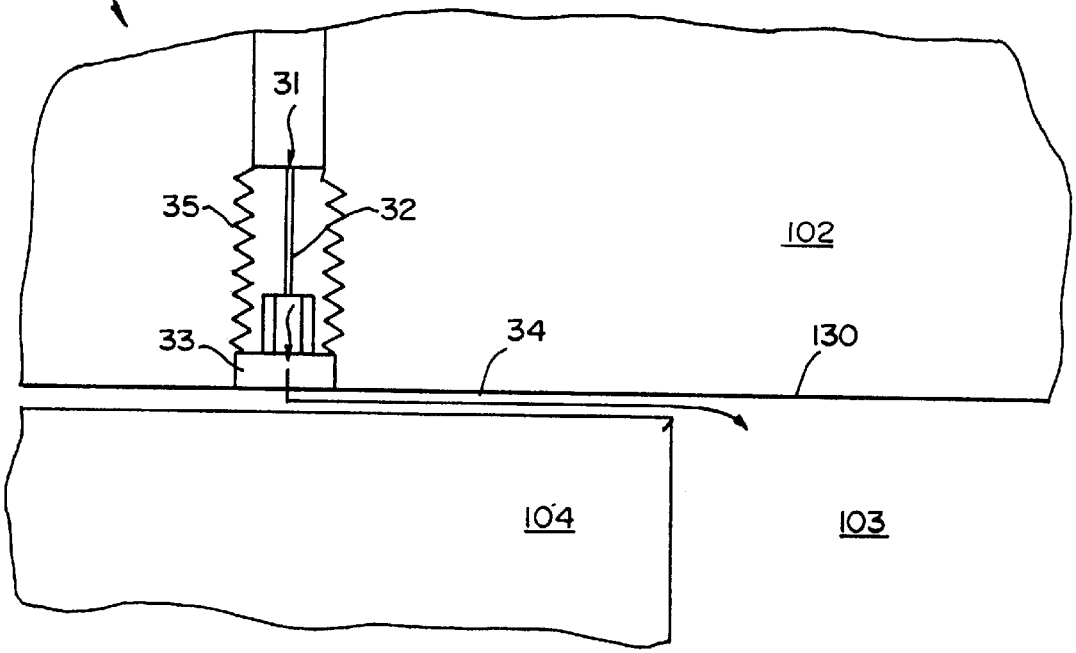
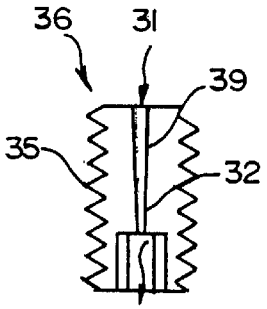
FIG. 6B
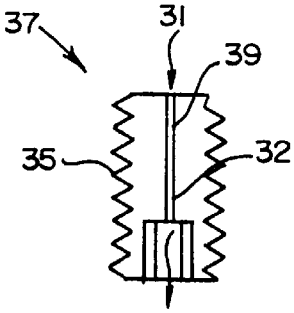
FIG. 6C
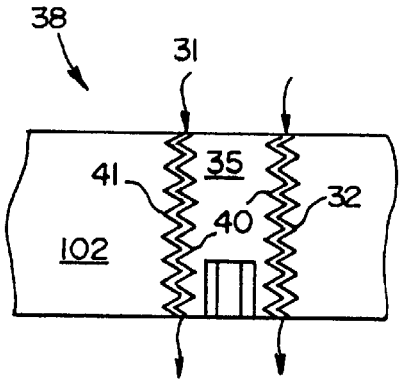
FIG. 6D

FREE PISTON PUMP

Claim is hereby made to the priority of provisional application Serial No. 60/153,614, filed on Sep. 13, 1999.

TECHNICAL FIELD

This invention relates generally to pumps, and more particularly concerns a new piston pump.

BACKGROUND OF THE INVENTION

Pumps raise the pressure of fluids that are mostly in the liquid phase. When reference is made to a fluid in the following description, what is meant is a liquid with, possibly, some vapor content. When reference is made to a liquid, what is meant is a fluid that is purely in the liquid phase. Two types of pumps have been used: (1) positive displacement pumps and (2) centrifugal pumps. A positive displacement pump pushes on a piston that pressurizes and displaces the fluid in a pumping chamber. A centrifugal pump raises the pressure of the fluid by accelerating the fluid radially outward with an impeller to a surrounding diffuser, where the fluid's high velocity is converted to a high pressure. Both of these types of pumps have problems associated with their use.

Positive displacement pumps have problems when they are used to pump cryogenic fluids (fluids at temperatures less than about 200° K., or −100° F.). One such problem occurs because a piston rod extends from the piston to a drive mechanism, such as a motor. The piston is in contact with the cryogenic fluid (cold) and the motor is at the ambient temperature or higher (warm). The difference in temperature causes heat conduction to the cryogenic fluid. It is typically expensive to cool cryogenic fluids, so adding heat to the cryogenic fluid is undesirable. Also, the addition of heat can boil the liquid content of the cryogenic fluid, which can reduce the performance of the pump. In addition, positive displacement pumps for cryogenic applications have used lubricated piston sleeves. The piston sleeves rub against the cylinder wall to create a rubbing seal. The piston sleeves are made from a different material than the cylinder wall. When the materials are cooled, the materials from which the piston sleeves are made contract to a greater extent than the materials from which the cylinder walls are made. Therefore, even if there is no gap between the sleeves and the cylinder walls at room temperature, there are significant gaps after the sleeves and the cylinder walls have cooled to their operating temperature. The large gaps lead to intolerably high leakage. For example, if a stainless steel cylinder has an inside diameter of 2.000 inches at 77° F., then it has an inside diameter of about 1.997 inches at 112° K. If the piston sleeve has an outside diameter of 2.000 inches at 77° F. (zero clearance between it and the cylinder wall), then it could have an outside diameter of about 1.978 inches at 112° K. The gap of 1.997−1.978=0.019 inches at 112 K would result in intolerably high leakage.

Centrifugal pumps have several problems. The major problem is cavitation. Cavitation is the formation of gas or vapor-filled bubbles resulting from a drop in pressure of a fluid without a change in temperature. Cavitation reduces the pressure rise of centrifugal pumps. Also, when cavitation occurs, the tiny bubbles erode the impellers. In addition, cavitation can create imbalance in the impeller and cause bearing failure. Cavitation is most likely to occur (and, therefore, especially a problem) when the fluid must be pumped from a temperature close to its saturation temperature. For example, in steam boiler systems, the feedpump must pump feedwater from the deaerator (at about 20 psia) to the boiler pressure (often above 1,000 psia). The water in the deaerator portion of the system is saturated, so the centrifugal feedpumps can have cavitation problems. Cavitation is also a problem when centrifugal pumps are used to pump cryogenic fluids, because cryogenic fluids often must be pumped from storage at temperatures at or near saturation. Also, cryogenic centrifugal pumps often have heat leakage (along their drive shafts, for example) that causes boiling of the cryogen and the same effects as cavitation.

SUMMARY OF THE INVENTION

The invention is a pump having a pump housing defining a chamber, and a free piston located within the chamber. The free piston defines one (or more) pumping chamber(s). Each pumping chamber receives fluid from one (or more) inlet port(s) and delivers liquid to one (or more) outlet port(s). The pump has an electromagnetic drive system for moving the piston within the chamber.

In one embodiment, the chamber and the piston are cylindrical. However, the chamber and the piston can have other shapes for their cross-sections, including the rectangular shape.

In one embodiment, the electromagnetic drive system is comprised of a power source, one (or more) drive element(s) secured to the pump housing, and the free piston (which acts as the driven element of the electromagnetic drive system). In another embodiment, the free piston is secured to a driven element and the assembly defines one (or more) pumping chamber(s) and one (or more) driven-element chamber(s). Fluid from the supply enters and leaves each driven-element chamber via one (or more) driven-element chamber port(s). The electromagnetic drive system in this embodiment is comprised of a power source, one (or more) drive element(s) secured to the pump housing, and the driven element secured to the free piston. Each drive element can be a solenoid coil, and the driven element can be a solenoid plunger.

In one embodiment, an inlet porting system allows liquid to enter each pumping chamber when the pressure in the pumping chamber is low. In another embodiment, an inlet check valve admits liquid into the pumping chamber when the pressure in the pumping chamber is low. In a preferred embodiment, each inlet check valve contains a poppet with a small mass and (therefore) inertia.

In one embodiment of the invention, an outlet porting system allows liquid to exit each pumping chamber when the pressure in the pumping chamber is high. In a preferred embodiment, the outlet porting system is contained in an injection needle. The injection needle is a small-diameter tube with most of its bore filled, except passages at each end between holes drilled radially through the wall near each end and near the place where the injection needle passes into the free piston, to which the injection needle is secured. The injection needle passes through a small-diameter passage that separates each pumping chamber from each outlet port. In another embodiment, an outlet check valve lets the liquid exit each pumping chamber when the pressure in the pumping chamber is high. In a preferred embodiment, the outlet check valve contains a poppet with a small mass and (therefore) inertia.

In one embodiment, the power source alternately supplies a solenoid coil with: (1) a positive voltage to induce a positive current through the solenoid coil; then (2) a negative voltage to reduce the current in the solenoid coil; and then (3) zero voltage when the current in the solenoid coil reaches a zero value. In a preferred embodiment, the power supply contains a capacitor that stores electrical energy drawn from the solenoid coil and returns the stored energy to the solenoid coil at a later time.

The pump can use three different types of bearings to separate the free piston from the pump housing: (1) rubbing bearings; (2) hydrostatic bearings; and (3) hydrodynamic bearings. These types of bearings can be used alone, or combinations of the three can be used together. In one embodiment, rubbing bearings are used, and the rubbing bearings are comprised of o-rings secured to the pump housing, which rub against the free piston. In another embodiment, the o-rings are secured to the free piston, and the o-rings rub against the chamber walls of the pump housing. In a preferred embodiment, the o-rings are made of polytetrafluoroethylene (PTFE). However, in other embodiments, the o-rings are made of different materials. For example, the o-rings can be made of materials that are soft (brass, for example) relative to the materials from which the free piston and pump housing are fabricated (stainless steel, for example).

In one embodiment, hydrostatic bearings separate the free piston from the pump housing. A key component of a hydrostatic bearing is a restrictor. In preferred embodiments, the hydrostatic bearings use screws to perform the restrictor function of the bearings. Screws can be used to form three different types of restrictors: (1) laser-drilled restrictors; (2) mechanically drilled restrictors; and (3) thread restrictors. For laser-drilled restrictors, a hole is laser-drilled down the axis of each screw. For mechanically drilled restrictors, a hole is drilled down the axis of each screw with a drill bit. For thread restrictors, the gap between the threads of each screw and the threaded hole in the pump housing functions as the restrictor in the bearings.

In one embodiment, hydrodynamic bearings separate the free piston from the pump housing. In a preferred embodiment, the hydrodynamic bearings are step-slider bearings. The steps of the step-slider bearings can be on the free piston or the chamber walls of the pump housing.

The pump contains a means for limiting leakage of liquid from the pumping chamber when the pressure in the pumping chamber is high. In one embodiment, clearance seals are used. In another embodiment, rubbing seals are used.

BRIEF DESCRIPTION OF THE DRAWINGS

FIG. 3 is a schematic diagram that illustrates another embodiment of the invention, in which an injection needle is used for an outlet porting system through which high pressure liquid exits the pumping chamber.

FIGS. 4*a*–4*d* are diagrams that illustrate the inlet and outlet check valves.

FIGS. 6*a*–6*d* are diagrams that illustrate hydrostatic bearings and different types of restrictors.

DETAILED DESCRIPTION OF THE INVENTION

Figure 1:
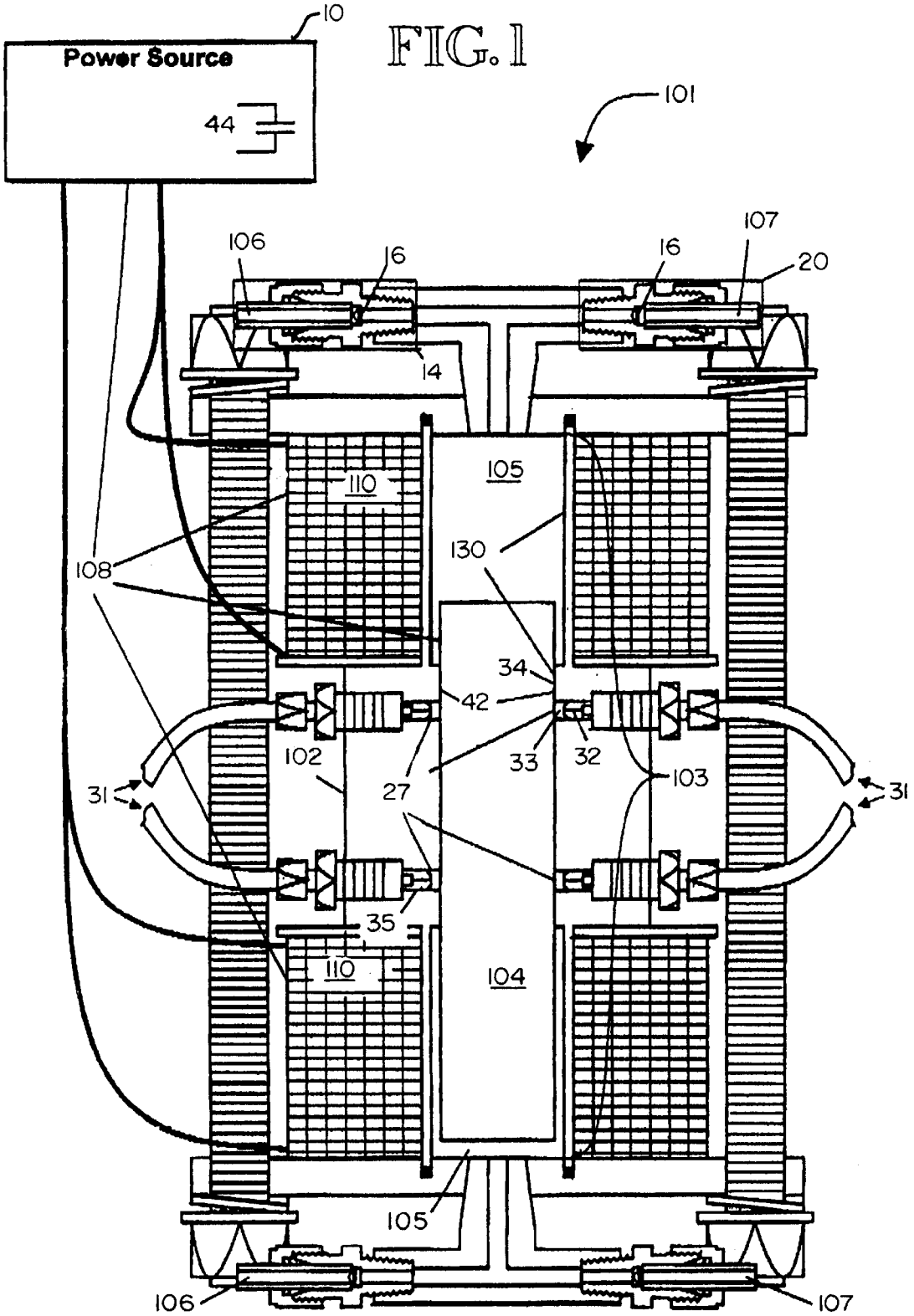
FIG. 1 is a schematic diagram that illustrates an embodiment of the invention, in which the free piston also serves as the solenoid plunger.

FIG. 1 is a schematic diagram that illustrates one embodiment of the present invention. The pump 101 has a pump housing 102 defining a pump housing chamber 103, and a free piston 104 located within the chamber 103. The free piston 104 is a piston that is not mechanically coupled with a drive system. The free piston 104 defines one (or more) pumping chamber(s) 105 within the pump housing chamber 103. Each pumping chamber 105 receives fluid from one (or more) inlet port(s) 106 and delivers liquid to one (or more) outlet port(s) 107. The pump 101 has an electromagnetic drive system 108 for moving the free piston 104 within the pump housing chamber 103. The use of a free piston 104 makes the pump 101 insensitive to cavitation, because the stroke of the free piston 104 can adjust to accommodate different levels of cavitation. The use of an electromagnetic drive system 108 minimizes heat leakage to the fluid, because heat conducts only through thin-wire electrical connections, rather than thick mechanical links, like in positive displacement pumps and centrifugal pumps.

In the embodiment shown in FIG. 1, the pump housing chamber 103 and the free piston 104 are cylindrical. It can be easy and inexpensive to fabricate the pump 101 if the pump housing chamber 103 and the free piston 104 are cylindrical. Also, the pump 101 can have high efficiency. However, the pump housing chamber 103 and the free piston 104 can have other shapes for their cross-sections (including the rectangular shape), and these other shapes can also offer benefits in terms of fabrication ease, low cost and high pump efficiency. For example, it is easy and inexpensive to produce rectangular laminated chambers and free pistons, which can have low electromagnetic losses.

In the embodiment shown in FIG. 1, the electromagnetic drive system 108 is comprised of a power source 10, two drive elements 110 secured to the pump housing 102, and the free piston 104 (which acts as the driven element of the electromagnetic drive system 108). In particular, the electromagnetic drive system 108 of the embodiment shown in FIG. 1 uses two solenoid coils as the drive elements 110, and the free piston 104 is a solenoid plunger. In the embodiment shown in FIG. 1, one of the drive elements 110 could be replaced with a spring secured to the pump housing 102 and the free piston 104. In this case, the term "free" piston 104 is used loosely, because the piston would be mechanically coupled with the spring, but the coupling would not be rigid. In this way, a drive element 110 would both pull on the free piston 104 and pump the fluid, and the spring would return the free piston 104 to its original position. The use of the spring would simplify the electromagnetic drive system 108, because it would eliminate the need for one of the drive elements 110 and the associated drive electronics in the power source 10. This could reduce the cost of the pump 101 and increase the robustness of the pump 101. However, the single drive element would have to meet the pumping requirements by itself.

In the embodiment shown in FIG. 1, inlet check valves 14 admit fluid into the pumping chamber(s) 105 when the pressure in the pumping chamber(s) 105 is low. Each inlet check valve 14 offers little resistance to the flow of liquid from the inlet port 106 into the pumping chamber(s) 105, and a high resistance to backflow of the liquid from the pumping chamber(s) 105 to the inlet port 106. In a preferred embodiment, each inlet check valve 14 contains a poppet 16 with a small mass and (therefore) inertia. The detailed schematic of the inlet check valve 14 is shown in FIG. 4. A poppet 16 with a small inertia enables pump 101 to operate at high frequencies, because only little leakage occurs due to backflow while the lightweight poppet 16 is quickly seating. It is advantageous for pumps to operate at high frequencies, because small and inexpensive pumps can be used to meet given flow requirements. The use of an inlet check valve 14 makes the pump 101 less sensitive to cavitation than the use of an inlet porting system 13, which is shown in the embodiment of FIG. 3. Cavitation leads to long strokes of the free piston 104 as the free piston 104 spends most of its travel compressing the vapor content of the fluid. With an inlet check valve 14, fluid enters the pumping chamber(s) 105 when the pressure in the pumping chamber(s) 105 is sufficiently low, independent of the position of the free piston 104. Therefore, when cavitation is large, fluid enters the pumping chamber(s) 105 after long strokes of the free piston 104, and when cavitation is small, fluid enters the pumping chamber(s) 105 after short strokes of the free piston 104.

FIGS. 4*a*–4*d* shows the operation of poppets 16. Each poppet 16 has a cone shape, with the outer surface of the cone defining a seating surface 46. A cylindrical poppet rim 47 with radial holes 48 through the poppet rim 47 is located at the base of the cone. When either the inlet check valve 14 or the outlet check valve 20 is open (FIGS. 4*a* and 4*c*), the top of the poppet rim 47 seats against a surface 449 in the inlet check valve 14 (or a surface 549 in the outlet check valve 20) and over a delivery hole 450, 550. Fluid flows in through a supply hole 451, 551; inward through the radial holes 48; and out through the delivery hole 450, 550. When either the inlet check valve 14 or the outlet check valve 20 is closed (FIGS. 4*b* and 4*d*) , the seating surface 46 seats against the edge of the supply hole 451, 551.

In the embodiment shown in FIG. 1, outlet check valves 20 let the liquid exit the pumping chamber(s) 105 when the pressure in the pumping chamber(s) 105 is high. The outlet check valve 20 offers little resistance to the flow of liquid from the pumping chamber(s) 105 to the outlet port 107, and a high resistance to backflow of the liquid from the outlet port 107 into the pumping chamber(s) 105. In a preferred embodiment, the outlet check valve 20 contains a poppet 16 with a small mass and (therefore) inertia. The poppet 16 of the inlet check valve 14 is the same as the poppet 16 of the outlet check valve 20, except it is inverted. Using identical parts for the inlet check valve 14 and the outlet check valve 20 reduces manufacturing costs.

The pump 101 has low leakage to the ambient environment, because the entire flow path of pump 101 is sealed from the ambient environment, as shown in the embodiment in FIG. 1. It is possible to seal the pump 101 because the pump 101 uses magnetic forces to pull on the free piston 104, and the magnetic forces can pass through the metal walls of the pump housing 102. On the other hand, positive displacement pumps use mechanical links, which require mechanical pass-throughs and leakage paths to the ambient environment. Low leakage is important when pumping a valuable liquid (for example, liquefied natural gas, LNG).

Figure 5:
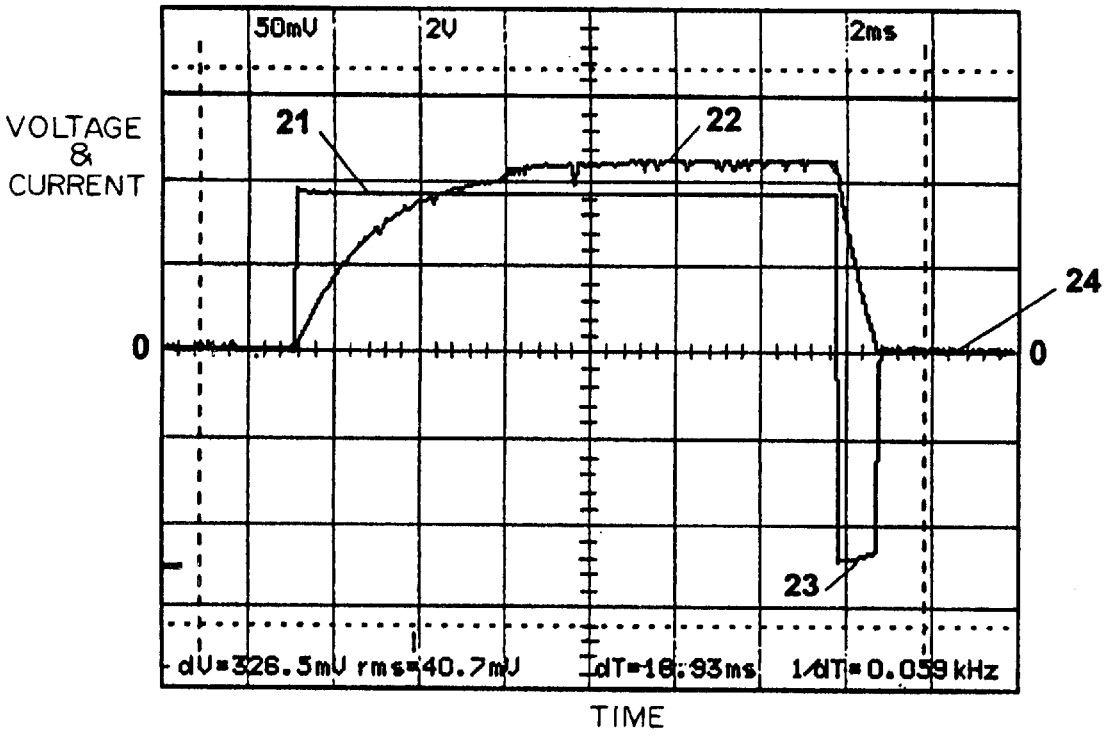
FIG. 5 is a plot of the voltage input to a solenoid coil from the power supply and the resulting current that flows through the coil.

FIG. 5 shows how power (voltage and current) is supplied to one embodiment of the invention. The power source 10 supplies a solenoid coil, which functions as the drive element 110 of the electromagnetic drive system 108, with: (1) a positive voltage 21 to induce a positive current 22 through the solenoid coil; then (2) a negative voltage 23 to reduce the current 22 in the solenoid coil; and then (3) zero voltage 24 when the current 22 in the solenoid coil reaches a zero value. When the supplied voltage is positive 21 and the resulting current 22 is positive, the power source 10 adds power to the solenoid coil. When the supplied voltage is negative 23 but the current 22 is still positive, the power source 10 draws power from the solenoid coil. In a preferred embodiment, the power source 10 contains a capacitor 44 that stores the electrical energy drawn from the solenoid coil and returns the stored energy to the solenoid coil at a later time.

The embodiment shown in FIG. 1 uses hydrostatic bearings 27 to separate the free piston 104 from the pump housing 102. The hydrostatic bearings can be used alone, or combined with rubbing bearings and/or hydrodynamic bearings. The term "hydrostatic bearings" 27 refers to fluid-film bearings in which bearing support forces are derived from a supply of high-pressure liquid, and the operation of the fluid-film bearings is independent of the relative motion of the parts. Liquid other than water can be used in hydrostatic bearings 27. FIGS. 6*a*–6*d* illustrate key features of the hydrostatic bearings 27 that are used in the embodiment of the invention shown in FIG. 1: source of high-pressure liquid 31; restrictor 32; pocket 33; and gap 34 between the free piston 104 and the chamber walls 130 of the pump housing 102. Hydrostatic bearings 27 operate as follows. If the free piston 104 moves toward the chamber walls 130 of the pump housing 102, then the resistance to flow through the gap 34 increases, and the flow of liquid decreases. With less liquid flow, the pressure drop across the restrictor 32 is less. Therefore, the pressure in the pocket 33 increases, and the increased pressure pushes the free piston 104 back to its central position in the chamber 103. On the opposite side of the chamber 103 (where the free piston 104 is moving away from the chamber walls 130), the opposite happens: a reduced pressure in the pocket 33 sucks the free piston 104 back toward the chamber walls 130.

In a preferred embodiment, the hydrostatic bearings 27 use screws 35 to form restrictors 32 of the hydrostatic bearings 27. As shown in FIGS. 6*a*–6*d*, screws 35 can be used to form three different types of restrictors 32: (1) laser-drilled restrictors 36 (FIG. 6*b*); (2) mechanically drilled restrictors 37 (FIG. 6*c*); and (3) thread restrictors 38 (FIG. 6*d*). For laser-drilled restrictors 36, a hole 39 is laser-drilled down the axis of each screw 35. For mechanically drilled restrictors 37, a hole 39 is drilled down the axis of each screw 35 with a drill bit. For thread restrictors 38, the gap between the threads 40 of each screw 35 and the threaded hole 41 in the pump housing 102 functions as the restrictor 32 in the hydrostatic bearings 27.

Hydrostatic bearings have advantages and disadvantages compared with rubbing bearings and hydrodynamic bearings. For example, hydrostatic bearings 27 can provide continuous strong bearing support forces without thermal-growth problems, but hydrostatic bearings 27 can be expensive because a supply of high-pressure liquid 31 must be provided to them at multiple locations.

The pump 101 contains a means for limiting leakage of liquid from the pumping chamber(s) 105 when the pressure in the pumping chamber(s) 105 is high. In the embodiment shown in FIG. 1, clearance seals 42 are used. Clearance seals 42 are convenient to use with hydrostatic bearings 27 or hydrodynamic bearings 28 (see the embodiment in FIG. 3) because, to produce bearing support forces, these types of bearings require a small (but finite) gap 34 between the free pist on 104 and the chamber walls 130 of the pump housing 102.

Figure 2:
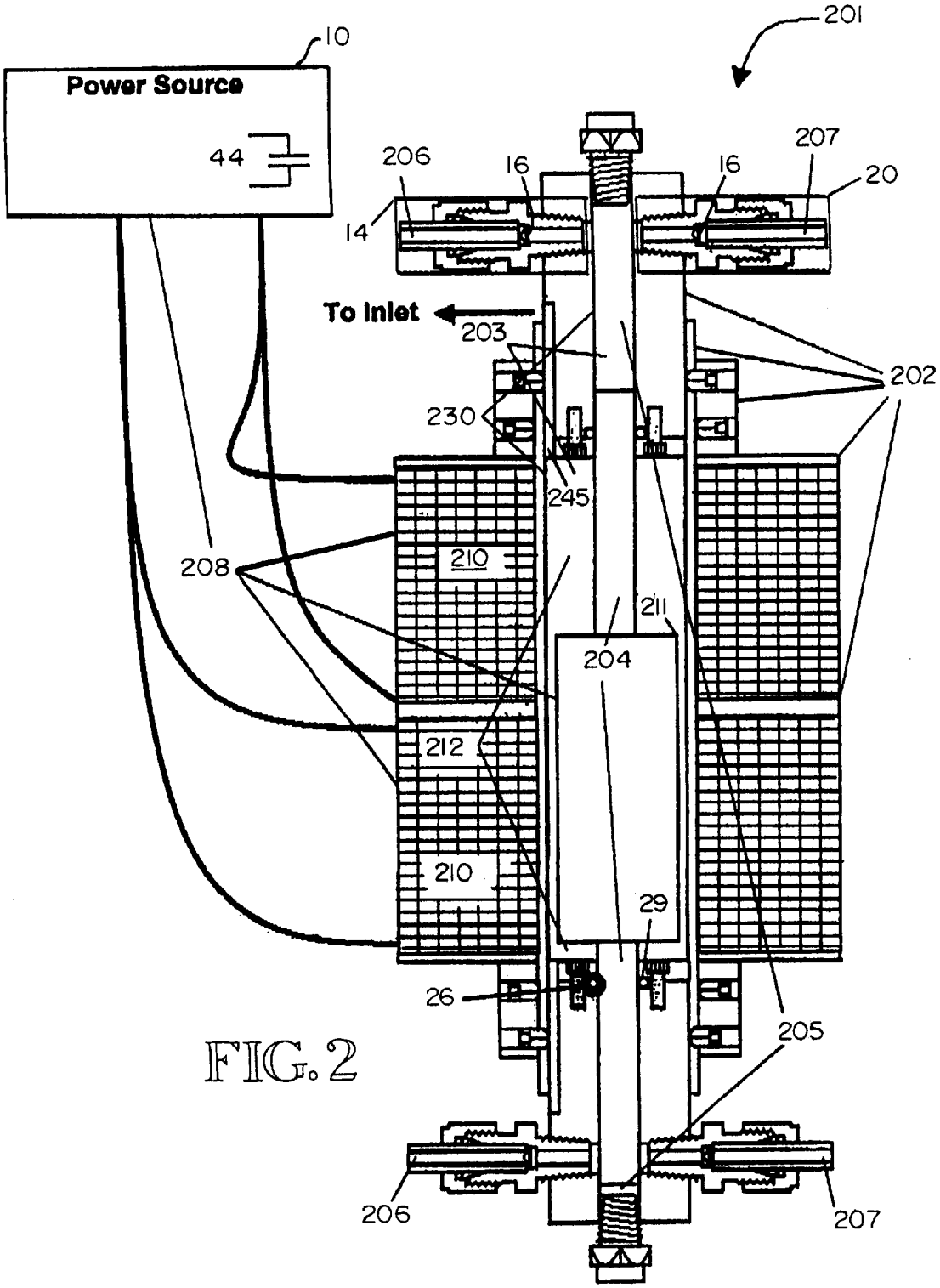
FIG. 2 is a schematic diagram that illustrates another embodiment of the invention, in which a solenoid plunger is attached to the free piston and drives the free piston.
Figure 2A:
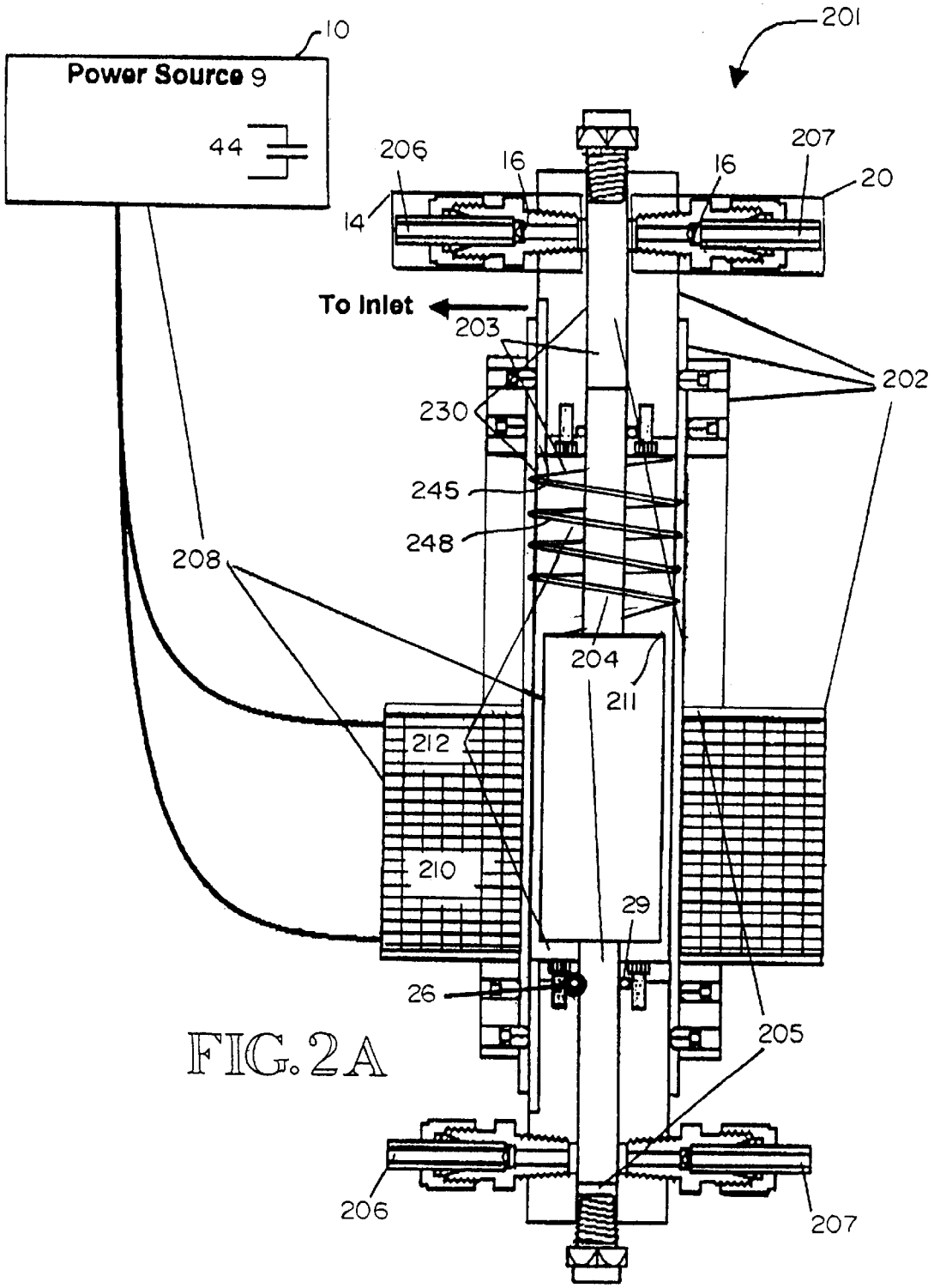
FIG. 2*a* is a schematic diagram of a modification of the embodiment of FIG. 2.

FIG. 2 is a schematic diagram that illustrates another embodiment of the present invention. The pump 201 has a pump housing 202 defining a chamber 203, and a free piston 204 located within the chamber 203. The free piston 204 defines one (or more) pumping chamber(s) 205. Each pumping chamber 205 receives fluid from one (or more) inlet port(s) 206 and delivers liquid to one (or more) outlet port(s) 207. The pump 201 has an electromagnetic drive system 208 for moving the free piston 204 within the chamber 203.

The embodiment of FIG. 2 is in general very similar in basic structure and operation to the embodiment of FIG. 1, as the description below indicates. However, the particular configuration and arrangement of the various elements of the pump, including for instance, the pump housing, the pump housing chamber, the free piston and the pumping chamber (s), do differ, as shown in the drawings. One primary difference between the embodiments of FIGS. 1 and 2 is in the bearings which separate the free piston from the pump housing.

In the embodiment shown in FIG. 2, the chamber 203 and the free piston 204 are cylindrical. It can be easy and inexpensive to fabricate the pump 201 if the chamber 203 and the free piston 204 are cylindrical. Also, the pump 201 can have high efficiency. However, the chamber 203 and the free piston 204 can have other shapes for their cross-sections (including the rectangular shape), and these other shapes can also offer benefits in terms of fabrication ease, low cost, and high pump efficiency. For example, it is easy and inexpensive to produce rectangular laminated chambers and free pistons, which can have low electromagnetic losses.

In the embodiment shown in FIG. 2, like that for FIG. 1, the free piston 204 is secured to a driven element 211 and the assembly defines two pumping chamber(s) 205 and two driven-element chamber(s) 212. Fluid from the supply enters the driven-element chamber(s) 212 and liquid leaves the driven-element chambers 212 via driven-element chamber port(s) 245. The electromagnetic drive system 208 in this embodiment is comprised of a power source 10, two drive elements 210 secured to the pump housing 202, and the driven element 211 secured to the free piston 204. The electromagnetic drive system of the embodiment shown in FIG. 2 uses two solenoid coils as the drive elements 210, and the driven element 211 is a solenoid plunger. In the embodiment shown in FIG. 2, one of the drive elements 210 could be replaced with a spring secured to the pump housing 202 and the free piston 204. In this case, the term "free" piston 204 is used loosely, because the piston would be mechanically coupled with the spring, but the coupling would not be rigid. In this way, a drive element 210 would both pull on the free piston 204 and pump the fluid, and the spring would return the free piston 204 to its original position. The use of the spring would simplify the electromagnetic drive system 208 because it would eliminate the need for one of the drive elements 210 and the associated drive electronics in the power source 10. This could reduce the cost of the pump 201 and increase the robustness of the pump 201. However, the single drive element would have to meet the pumping requirements by itself.

In the embodiment shown in FIG. 2, like in FIG. 1, inlet check valves 14 admit fluid into the pumping chambers 205 when the pressure in the pumping chambers 205 is low. Each inlet check valve 14 offers little resistance to the flow of liquid from the inlet port 206 into the pumping chamber 205, and a high resistance to backflow of the liquid from the pumping chamber 205 to the inlet port 206. In a preferred embodiment, each inlet check valve 14 contains a poppet 16 with a small mass and (therefore) inertia. A poppet 16 with a small inertia enables pump 201 to operate at high frequencies, because only little leakage occurs due to backflow while the lightweight poppet 16 is quickly seating. It is advantageous for pumps to operate at high frequencies because small and inexpensive pumps can be used to meet given flow requirements. The use of an inlet check valve 14 makes the pump 201 less sensitive to cavitation than the use of an inlet porting system 13 which is shown in FIG. 3. Cavitation leads to long strokes of the free piston 204 as the free piston 204 spends most of its travel compressing the vapor content of the fluid. With an inlet check valve 14, fluid enters the pumping chamber(s) 205 when the pressure in the pumping chamber(s) 205 is sufficiently low, independent of the position of the free piston 204. Therefore, when cavitation is large, fluid enters the pumping chamber(s) 205 after long strokes of the free piston 204, and when cavitation is small, fluid enters the pumping chamber(s) 205 after short strokes of the free piston 204.

In the embodiment shown in FIG. 2, outlet check valves 20 let the liquid exit the pumping chamber(s) 205 when the pressure in the pumping chamber(s) 205 is high. The outlet check valve 20 offers little resistance to the flow of liquid from the pumping chamber(s) 205 to the outlet port 207, and a high resistance to backflow of the liquid from the outlet port 207 into the pumping chamber(s) 205. In a preferred embodiment, the outlet check valve 20 contains a poppet 16 with a small mass and (therefore) inertia. The poppet 16 of the inlet check valve 14 is the same as the poppet 16 of the outlet check valve 20, except it is inverted. Using identical parts for the inlet check valve 14 and the outlet check valve 20 reduces manufacturing costs.

The pump 201 has low leakage to the ambient environment, because the entire flow path of the pump 201 is sealed from the ambient environment, as shown in the embodiments in FIG. 2. It is possible to seal the pump 201 because the pump 201 uses magnetic forces to pull on the free piston 204, and the magnetic forces can pass-through the metal walls of the pump housing 202. On the other hand, positive displacement pumps use mechanical links, which require mechanical pass-throughs and leakage paths to the ambient environment. Low leakage is important when pumping a valuable liquid (for example, liquefied natural gas, LNG).

The embodiment shown in FIG. 2 uses rubbing bearings 26 to separate the free piston 204 from the pump housing 202. The rubbing bearings can be used alone, or combined with hydrostatic bearings and/or hydrodynamic bearings. The rubbing bearings 26 shown in FIG. 2 are comprised of o-rings 29 secured to the pump housing 202, and the o-rings 29 rub against the free piston 204. In another embodiment, the o-rings 29 are secured to the free piston 204, and the o-rings 29 rub against the chamber walls 230 of the pump housing 202. In a preferred embodiment, the o-rings 29 are made of polytetrafluoroethylene (PTFE). However, in other embodiments, the o-rings 29 are made of different materials. For example, the o-rings 29 can be made of materials that are soft (brass, for example) relative to the materials from which the free piston 204 and pump housing 202 are fabricated (stainless steel, for example) The best choice of material for the o-rings 29 depends on the type of fluid and the operating requirements.

The pump 201 contains a means for limiting leakage of liquid from the pumping chamber 205 when the pressure in the pumping chamber 205 is high. In the embodiment shown in FIG. 2, rubbing seals are used. Rubbing seals are convenient to use with rubbing bearings 26, because the rubbing elements (for example, FIG. 2 shows o-rings 29) seal and provide bearing forces.

FIG. 3 is a schematic diagram that illustrates another embodiment of the present invention. The pump 301 has a pump housing 302 defining a pump housing chamber 303, and a free piston 304 located within the pump housing chamber 303. The free piston 304 is a piston that is not mechanically coupled with a drive system. The free piston 304 defines one (or more) pumping chamber(s) 305. Each pumping chamber 305 receives fluid from one (or more) inlet port(s) 306 and delivers liquid to one (or more) outlet port(s) 307. The pump 301 has an electromagnetic drive system 308 for moving the free piston 304 within the chamber 303. The use of a free piston 304 makes the pump 301 insensitive to cavitation, because the stroke of the free piston 304 can adjust to accommodate different levels of cavitation. The use of an electromagnetic drive system 308 minimizes heat leakage to the fluid, because heat conducts only through thin-wire electrical connections, rather than thick mechanical links, like in positive displacement pumps and centrifugal pumps.

As explained below, the embodiment of FIG. 3 also is similar in many respects to the embodiments of FIGS. 1 and 2. The particular arrangement and configuration of many of the parts are different, however, from those embodiments. The inlet and outlet porting arrangements are different, as explained below, as is the bearing arrangement, also as explained below.

In the embodiment shown in FIG. 3, the chamber 303 and the free piston 304 are cylindrical. It can be easy and inexpensive to fabricate the pump 301 if the chamber 303 and the free piston 304 are cylindrical. Also, the pump 301 can have high efficiency. However, the chamber 303 and the free piston 304 can have other shapes for their cross-sections (including the rectangular shape), and these other shapes can also offer benefits in terms of fabrication ease, low cost, and high pump efficiency. For example, it is easy and inexpensive to produce rectangular laminated chambers and free pistons, which can have low electromagnetic losses.

In the embodiment shown in FIG. 3, the electromagnetic drive system 308 is comprised of a power source 10, two drive elements 310 secured to the pump housing 302, and the free piston 304 (which acts as the driven element of the electromagnetic drive system 308). In particular, the electromagnetic drive system 308 of the embodiment shown in FIG. 3 uses two solenoid coils as the drive elements 310, and the free piston 304 is a solenoid plunger. In the embodiment shown in FIG. 3, one of the drive elements 310 could be replaced with a spring secured to the pump housing 302 and the free piston 304. In this case, the term "free" piston 304 is used loosely, because the piston would be mechanically coupled with the spring, but the coupling would not be rigid. In this way, a drive element 310 would both pull on the free piston 304 and pump the fluid, and the spring would return the free piston 304 to its original position. The use of the spring would simplify the electromagnetic drive system 308 because it would eliminate the need for one of the drive elements 310 and the associated drive electronics in the power source 10. This could reduce the cost of the pump 301 and increase the robustness of the pump 301. However, the single drive element would have to meet the pumping requirements by itself.

In the embodiment shown in FIG. 3, an inlet porting system 13 allows fluid to enter the pumping chamber(s) 305 when the pressure in the pumping chamber(s) 305 is low. With an inlet porting system 13, fluid can enter the pumping chamber(s) 305 only after the free piston 304 has arrived at a particular position in the chamber 303 of the pump housing 302. Therefore, an inlet porting system 13 makes the pump 301 more sensitive to cavitation than an inlet check valve 314. However, an inlet porting system 13 requires no contacting parts, unlike an inlet check valve 14. Therefore, a pump 301 with an inlet porting system 13 has the potential for a longer life than a pump 301 that uses an inlet check valve 14.

In the embodiment shown in FIG. 3, an outlet porting system 17 allows liquid to exit the pumping chamber(s) 305 when the pressure in the pumping chamber(s) 305 is high. In a preferred embodiment, the outlet porting system 17 is contained in an injection needle 18. The injection needle 18 is a small-diameter tube with most of its bore filled, except passages 15 at each end between holes 25 drilled radially through the wall near each end and near the place where the injection needle 18 passes into the free piston 304, to which the injection needle is secured. The injection needle 18 passes through a small-diameter passage 19 that separates each pumping chamber 305 from each outlet port 307. The same descriptions of sensitivity to cavitation vs. pump life for an inlet porting system 13 and an inlet check valve 14 also apply for the outlet porting system 17 and the outlet check valve 20.

The pump 301 has low leakage to the ambient environment, because the entire flow path of the pump 301 is sealed from the ambient environment, as shown in the embodiment in FIG. 3. It is possible to seal the pump 301 because the pump 301 uses magnetic forces to pull on the free piston 304, and the magnetic forces can pass-through the metal walls of the pump housing 302. On the other hand, positive displacement pumps use mechanical links, which require mechanical pass-throughs and leakage paths to the ambient environment. Low leakage is important when pumping a valuable liquid (for example, liquefied natural gas, LNG).

The embodiment shown in FIG. 3 uses hydrodynamic bearings 28 to separate the free piston 304 from the pump housing 302. The hydrodynamic bearings can be used alone, or combined with hydrostatic bearings and/or rubbing bearings. The term "hydrodynamic bearings" 28 refers to fluid-film bearings in which bearing support forces are produced by the relative motion of the parts. In the embodiment shown in FIG. 3, the hydrodynamic bearings 28 are step-slider bearings. The steps 29 of the step-slider bearings can be on either the free piston 304 or the chamber walls 330 of the pump housing 302, but the opposite surface (on either the free piston 304 or the chamber walls 330) is smooth.

The pump 301 contains a means for limiting leakage of liquid from the pumping chamber 305 when the pressure in the pumping chamber 305 is high. In the embodiment shown in FIG. 3, clearance seals 42 are used. Clearance seals 42 are convenient to use with hydrodynamic bearings 28 because, to produce bearing support forces, these types of bearings require a small (but finite) gap between the free piston 304 and the chamber walls 330 of the pump housing 302.

Although a preferred embodiment of the invention has been disclosed here for purposes of illustration, it should be understood that various changes, modifications and substitutions may be incorporated without departing from the spirit of the invention, which is defined by the claims which follow.

What is claimed is:

1. A pump, comprising:

a pump housing defining a chamber;

a free piston located within the chamber, defining at least one pumping chamber therein, with each pumping chamber adapted to receive fluid from and be in fluid communication with at least one inlet port and adapted to deliver liquid to and be in fluid communication with at least one outlet port; and an electromagnetic drive system for moving the free piston within the chamber.

2. The pump of claim 1, wherein the pumping chamber and the piston have cylindrical or rectangular cross-sections.

3. The pump of claim 1, wherein the electromagnetic drive system comprises a power source, a driving element secured to the pump housing, and the free piston.

4. The pump of claim 1, wherein the electromagnetic drive system comprises a power source, a driving element secured to the pump housing, a spring secured to the pump housing and the free piston , and the free piston.

5. The pump of claim 1, wherein the free piston is secured to a driven element and the pump housing defines at least one pumping chamber and at least one driven-element chamber, wherein the driven-element chamber has at least one driven-element chamber port through which fluid enters from a supply thereof or exits to the supply, and wherein the electromagnetic drive system comprises a power source, two drive elements secured to the pump housing, and an assembly of the driven element and the free piston.

6. The pump of claim 1, wherein the free piston is secured to a driven element and the pump housing defines at least one pumping chamber and at least one driven-element chamber, wherein the driven-element chamber has at least one driven-element chamber port through which fluid enters through a supply thereof or exits to the supply, and wherein the electromagnetic drive system comprises a power source, a drive element secured to the pump housing, a spring secured to the pump housing and the free piston, and the assembly of the free piston and the driven element.

7. The pump of claim 3, wherein the drive element is a solenoid coil and the driven element is a solenoid plunger.

8. The pump of claim 4, wherein the drive element is a solenoid coil and the driven element is a solenoid plunger.

9. The pump of claim 5, wherein the drive element is a solenoid coil and the driven element is a solenoid plunger.

10. The pump of claim 6, wherein the drive element is a solenoid coil and the driven element is a solenoid plunger.

11. The pump of claim 1, further comprising an inlet porting system and an outlet porting system, wherein the inlet porting system allows fluid to enter the pumping chamber when the pressure in the pumping chamber is sufficiently low, and wherein the outlet porting system allows liquid to exit the pumping chamber when the pressure in the pumping chamber is sufficiently high.

12. The pump of claim 11, wherein the outlet porting system is contained in an injection needle, which passes through a small-diameter passage that separates each pumping chamber from each outlet port, wherein the injection needle is a small-diameter tube with most of its bore filled, except passages at each end thereof between holes drilled radially through the wall near each end and near the place where the injection needle passes into the free piston, to which the injection needle is secured.

13. The pump of claim 1, further comprising at least one inlet check valve and at least one outlet check valve, wherein each inlet check valve offers a low resistance to the flow of fluid from the inlet port into the pumping chamber and a high resistance to backflow of the fluid from the pumping chamber to the inlet port, and wherein each outlet check valve offers little resistance to the flow of liquid from the pumping chamber to the outlet port and a high resistance to backflow of liquid from the outlet port into the pumping chamber.

14. The pump of claim 13, wherein the inlet check valve and the outlet check valve contain poppets with small masses.

15. The pump of claim 7, wherein the power source is adapted to supply in sequence each solenoid coil with: (1) a positive voltage to induce a positive current through the coil; (2) a negative voltage to reduce the current in the coil; and then (3) zero voltage when the current in the coil reaches a zero value.

16. The pump of claim 15, wherein the power source contains a capacitor for storing electrical energy when the voltage applied to the solenoid coil is negative and a means for returning this energy to a solenoid coil at a later time.

17. The pump of claim 1, including rubbing bearings, hydrostatic bearings, or hydrodynamic bearings to separate the free piston from the pump housing.

18. The pump of claim 17, wherein the rubbing bearings are comprised of o-rings secured to the pump housing, wherein the o-rings rub against the free piston, or o-rings secured to the free piston, wherein the o-rings rub against the chamber walls of the pump housing.

19. The pump of claim 18, wherein the o-rings are made of a soft material relative to the free piston or pump housing material.

20. The pump of claim 17, wherein the hydrostatic bearings use screws to perform a restrictor function in the bearings.

21. The pump of claim 20, wherein each screw has a hole drilled down its axis, and the hole functions as the restrictor in the bearing.

22. The pump of claim 20, wherein the gap between the threads of each screw and the threaded hole in the pump housing functions as the restrictor in the bearing.

23. The pump of claim 17, wherein the hydrodynamic bearings are step-slider bearings.

24. The pump of claim 23, wherein the steps of the step-slider bearings are on the free piston or on the chamber walls of the pump housing.

25. The pump of claim 1, including a combination of rubbing bearings, hydrostatic bearings, and/or hydrodynamic bearings to separate the free piston from the pump housing.

26. The pump of claim 1, including seals to limit leakage of high-pressure liquid from the pumping chamber.

* * * * *